United States Patent [19]

Martin

[11] 4,399,619

[45] Aug. 23, 1983

[54] MACHINE FOR DRYING AND BUTT-JOINTING WOOD VENEER BY CONTINUOUS CONTACT ENGAGEMENT

[76] Inventor: Jean-Marie M. Martin, 23, rue de Turin, 75008 Paris (Seine), France

[21] Appl. No.: 263,399

[22] Filed: May 13, 1981

[30] Foreign Application Priority Data

May 20, 1980 [FR] France ..... 80 11269

[51] Int. Cl.[3] ..... F26B 13/12

[52] U.S. Cl. ..... 34/148; 34/162; 156/304.1; 156/504

[58] Field of Search ..... 34/95, 148, 151, 152, 34/153, 162, 163; 156/304, 502, 504; 100/151-154, 118, 119, 120; 144/281 B

[56] References Cited

U.S. PATENT DOCUMENTS

| | | | |
|---|---|---|---|
| 2,071,999 | 2/1937 | Dike | 144/281 B |
| 2,142,932 | 1/1939 | Beard | 144/281 B |
| 2,720,231 | 10/1955 | Hessler et al. | 144/281 B |
| 2,960,023 | 11/1960 | Greiner et al. | 100/152 |
| 3,003,541 | 10/1961 | Prentice et al. | 156/304 X |
| 3,669,804 | 6/1972 | Clausen et al. | 156/304 X |
| 3,896,559 | 7/1975 | Martin | 34/162 |
| 3,907,473 | 9/1975 | De Mets | 100/151 X |
| 3,963,555 | 6/1976 | Zweig | 156/304 X |
| 4,214,378 | 7/1980 | Martin | 34/148 |

*Primary Examiner*—Larry I. Schwartz
*Attorney, Agent, or Firm*—Karl W. Flocks; A. Fred Starobin; Sheridan Neimark

[57] ABSTRACT

A machine for drying and butt-jointing unwound or sectioned wood veneer by continuous contact engagement comprises an effective drying and jointing zone, which includes an input conveyor and an output conveyor driven independently, each including an upper set and a lower set forming pairs of endless chains with pallets. The chains each have an active run and a return run; sprockets and roller means running on supporting guiderails drive said chains simultaneously. Pairs of said active runs face each other and compress the veneer therebetween and convey it in the longitudinal direction of the machine. The return runs are heated. First pressure means are positioned at the input of the effective zone, directly over the pairs of chains of the input conveyor; second pressure means are positioned at the output of the effective zone, directly over the pairs of chains of the output conveyor. Also input and output pressure means extend identically over the whole effective drying and jointing zone of the machine, said pressure means comprising respectively as many elastically deformable chambers as there are pairs of upper and lower endless chains in the associated conveyor. The chambers are supplied with fluid under pressure and each is arranged between a fixed upper support plate constituted by a girder, which is fastened to the machine and with which are if necessary associated lateral members for holding the chamber, and a flexible and relatively heavy layer, fixed in the longitudinal direction of the machine, having a width corresponding to that of the associated upper chain, bearing directly on said rollers of the active run of said chain and subjected to pressure from said deformable chamber pressing against said plate.

13 Claims, 21 Drawing Figures

FIG.7
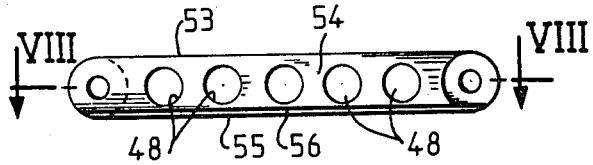
FIG.8
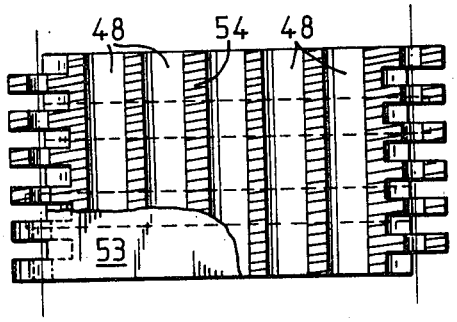
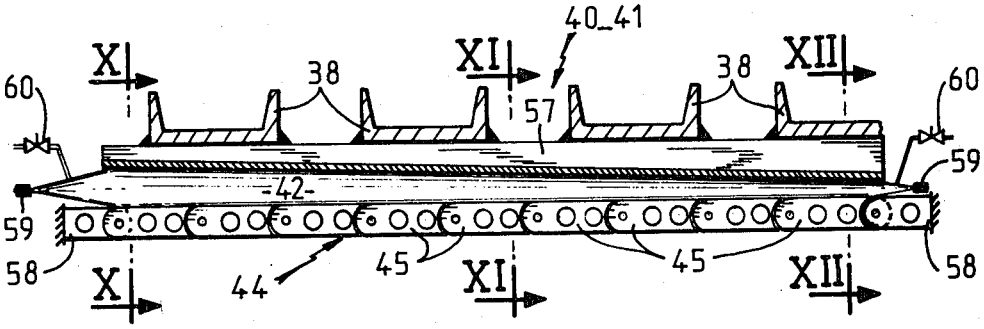
FIG.9
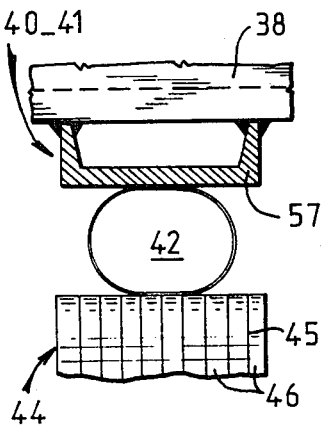
FIG.10
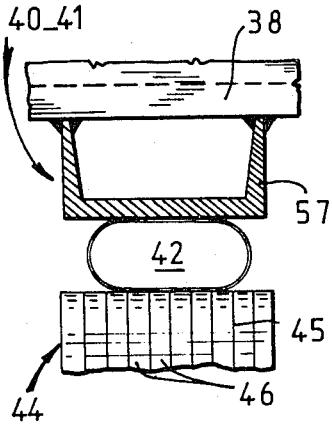
FIG.11
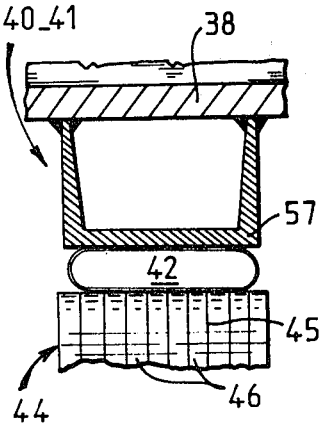
FIG.12

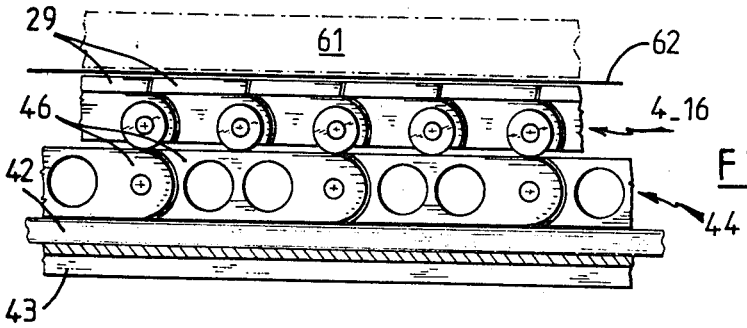
FIG.13A
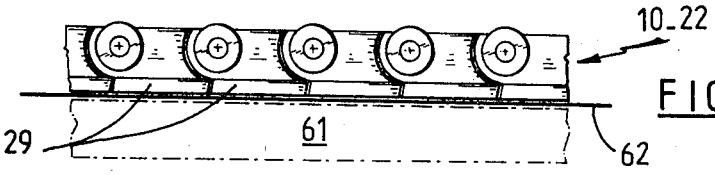
FIG.13B
FIG.14
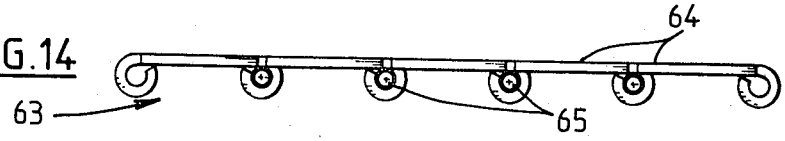
FIG.15
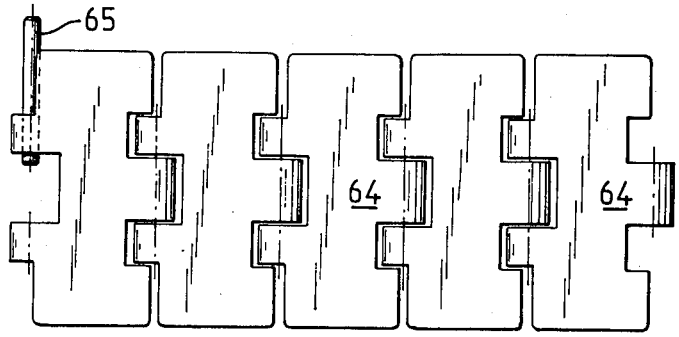
FIG.16
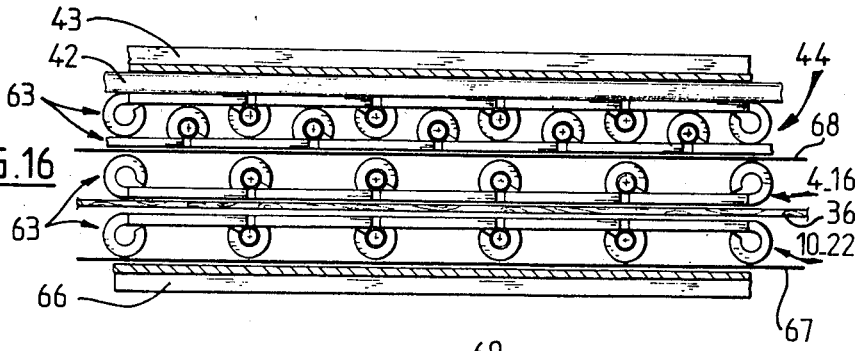
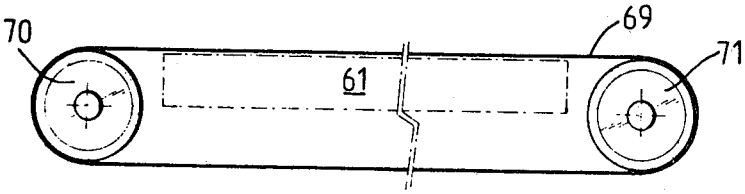
FIG.17

MACHINE FOR DRYING AND BUTT-JOINTING WOOD VENEER BY CONTINUOUS CONTACT ENGAGEMENT

BACKGROUND OF THE INVENTION

Applicant has already described in U.S. Pat. No. 4,214,378 a machine for drying and/or butt-jointing "green" or "non-green" wood veneer by continuous contact engagement, said veneer being fed by being unwound or sectioned and offered up in the direction of the wood grain or in a direction perpendicular thereto, in which machine an effective drying and jointing zone is defined and which comprises an input conveyor belt and an output conveyor belt, which are driven independently and each constituted by upper and lower sets of endless chains with pallets or with blocks, these chains each comprising an active run and a return run and driven simultaneously by sprockets and running by roller means on supporting guide rails, their opposite active runs compressing and conveying the veneer, whilst their return runs are heated.

In accordance with the aforesaid patent, the shearing force, which is exerted beforehand in the transfer zone from one section to the next in machines with several consecutive sections, is advantageously distributed over the whole surface of the veneer and not on a single transverse line, due to the fact that the input and output conveyors are juxaposed contiguously in the effective drying and jointing zone of the machine, in the form of groups of active runs of alternating chains belonging to each of said conveyors, arranged in an even number of chains in one conveyor and an odd number of chains in the other conveyor, first pressure means being provided at the entrance to the effective zone, vertically above the chains of said input conveyor, and second pressure means arranged at the exit of the effective zone, vertically above the chains of said output conveyor, the input conveyor being driven at a higher speed than the output conveyor.

In the effective zone of this machine, the veneer is hence transported continuously between two movable layers of juxtaposed and contiguous chains, whose pallets or blocks form a flat united heating surface similar to a movable heating plate. The rollers of the active runs of the chains form the lower layer running on associated guide rails, whilst the active runs of the chains forming the upper layer are inverted, rollers upwards, and rest through their own weight on the veneer supported by the lower layer. Due to the fact that each active run of the upper layer is exactly superimposed on its homolog of the lower layer and advances at the same speed as the latter, the veneers are subjected to uniformly distributed pressure corresponding to the weight of the pallets or blocks and enabling in particular, drying by contact, or back-gluing, if the weight is sufficient.

However, Applicant has now realised that the pressure so-applied to the veneer could not be varied, since it is determined by only the weight of the pallets or blocks forming the upper layer, except, obviously, at the level of the input and output pressure devices of this machine according to the aforesaid patent.

SUMMARY OF THE INVENTION

It is therefore an object of the present invention to provide a machine which overcomes this drawback and which provides a solution to this problem by making it possible to construct a machine of the aforesaid type in which the pressure applied to the veneers can be modified as desired throughout the effective zone of the machine.

More specifically, the invention is embodied in a machine for drying and butt-jointing unwound or sectioned wood veneer by continuous contact engagement, in which an effective drying and jointing zone is defined and which includes an input conveyor and an output conveyor which are driven independently and are each formed by upper and lower sets of endless chains with pallets or with blocks, said chains each having an active run and a return run and being driven simultaneously by sprockets and running over rollers on supporting guide-rails their facing active runs compressing and conveying the veneer in the longitudinal direction of the machine, whilst their return runs are heated, and which comprises in addition a first pressure means provided at the entrance to the effective zone, vertically above the chains of the input conveyor, and second pressure means provided at the exit from said effective zone, vertically above the chains of said output conveyor, said machine being characterised by the fact that the entrance and exit pressure means extend indentically over the whole effective drying and jointing zone of the machine and comprise respectively as many elastically deformable chambers as there are pairs of upper and lower endless chains in the associated conveyor, these chambers being fed with pressurized fluid and arranged each between a fixed upper support plate constituted by a girder, which is built on to the machine and with which are possibly associated lateral retaining members for the chamber, and a flexible and relatively weighty layer, fixed in the longitudinal direction of the machine, having a width corresponding to that of the associated upper chain, bearing directly on the rollers of the active run of this chain and subjected to the pressure of the deformable chamber which is supported against the plate.

BRIEF DESCRIPTION OF THE DRAWINGS

The invention well be better understood by means of the following description of several embodiments, given purely by way of example, and with reference to the accompanying drawings, in which:

FIG. 7 is a side view of a link forming part of the pressure means seen in FIG. 6;

FIG. 8 is a partial sectional view on the line VIII—VIII of FIG. 7;

FIG. 9 is a side view of a pressure means with and inclined girder;

FIGS. 10, 11 and 12 are cross-sectional views seen respectively on lines X—X, XI—XI and XII—XII of FIG. 9.

FIGS. 13A and 13B are partial side views of contact heating means respectively associated with the return runs of the top and bottom chains.

FIGS. 14 and 15 are respectively partial lateral and top views, of a chain section with hinged pallets.

FIG. 16 is a partial side view of the effective drying and/or jointing zone in a machine using hinged pallet chains.

FIG. 17 is a diagrammatic side view of a lower conveyor of the thin endless belt type, with which is associated a contact heating means.

In these Figures, the same elements are denoted by the same reference numerals.

DESCRIPTION OF THE PREFERRED EMBODIMENTS

Figure 1:
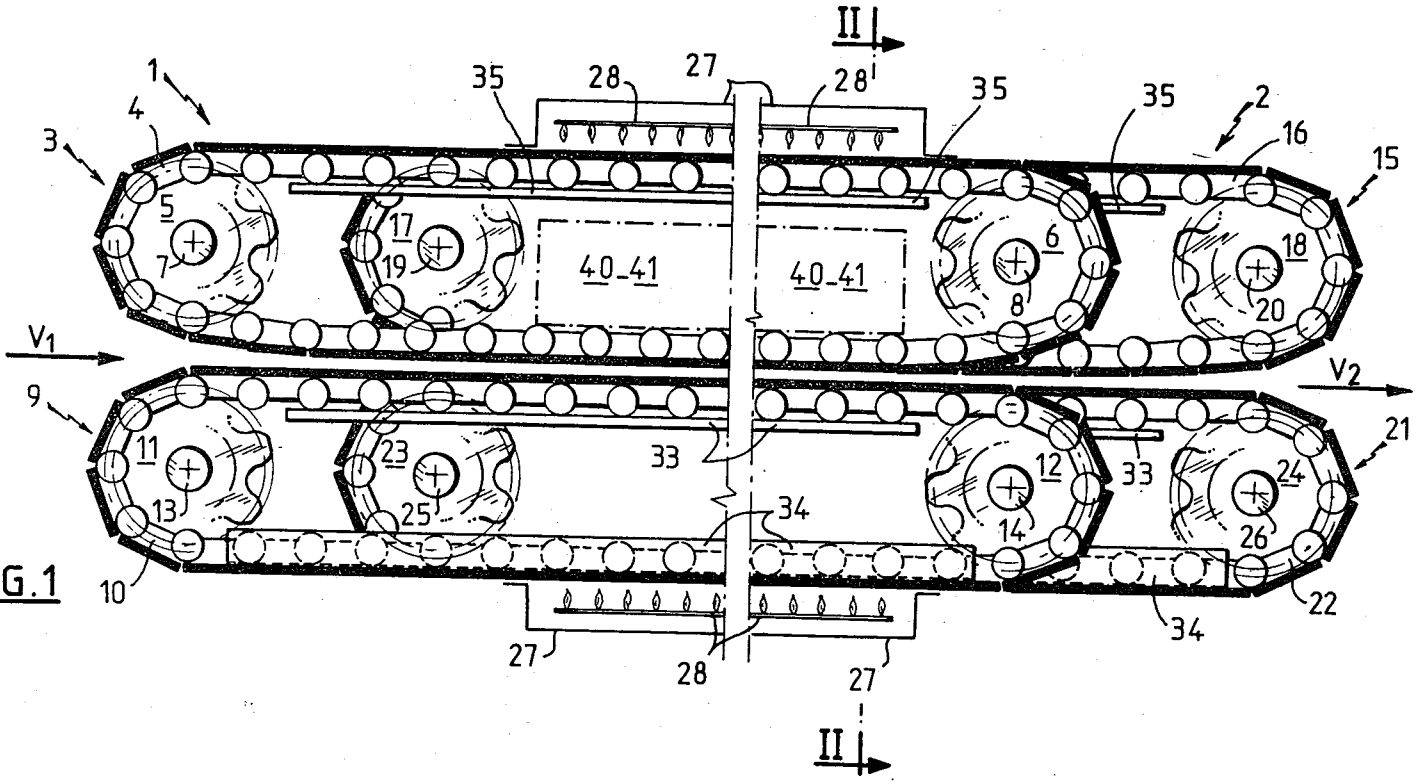
FIG. 1 is a side elevation view, on a smaller scale, of an embodiment of the machine according to the aforesaid patent, showing diagrammatically the pressure means according to the present invention.

Referring now to FIG. 1, the latter shows the essentials of a machine for drying and/or butt-jointing unwound or sectioned veneer by continuous contact engagement. As already indicated in the aforesaid patent, such a machine comprises an input conveyor belt and an output conveyor belt, which are respectively denoted by 1 and by 2 and which are independently driven. The input conveyor 1 includes an upper set 3 of endless chains 4, driven by sprockets 5 and 6 respectively borne by drive shafts 7 and 8, and a lower set 9 of endless chains 10, driven by sprockets 11 and 12 respectively borne by drive shafts 13 and 14. In the same manner, the output conveyor 2 includes an upper set 15 of endless chains 16, driven by sprockets 17 and 18 respectively borne by drive shafts 19 and 20 and a lower set 21 of endless chains 22, driven by sprockets 23 and 24, respectively borne by drive shafts 25 and 26. It should be noted that the input conveyor 1 operates at a speed $V_1$ generally higher than the speed $V_2$ of the output conveyor 2.

In principle, one of the conveyors possesses an even number of chains, whilst the other conveyor possesses an odd number thereof. The active runs of the chains of one and the other conveyor alternate contiguously at the level of an effective drying and butt-jointing zone of the machine, which is situated between the aforementioned drive wheels, whilst their return runs are heated, for example in enclosures 27 encircling ramps 28 of gas burners.

Figure 2:
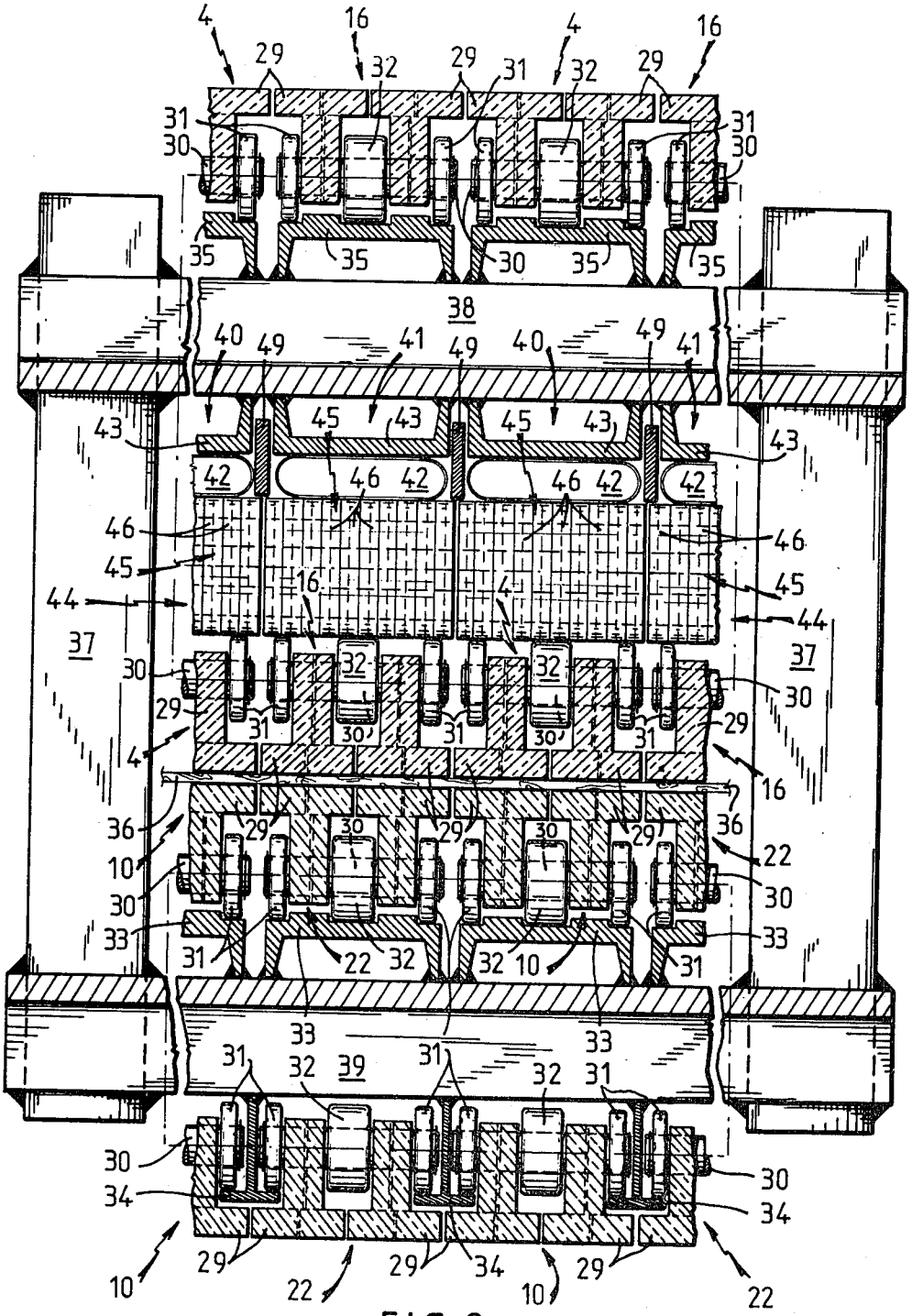
FIG. 2 is a cross-sectional view taken along the line II—II of FIG. 1 and showing, on a large scale with respect to the latter, the arrangement of the pressure means with respect to the essential elements of the machine.

In addition, according to the aforesaid patent, all the chains are constituted by links 29 which can be with pallets or with blocks, as shown in FIG. 2, and which are articulated in pairs on axles 30 bearing, for example, two narrow side rollers 31 serving only for rolling and a large central roller 32 serving both for rolling and for driving on its engagement with the sprockets. Generally, chains of this type are customarily called "roll and block chains".

For the lower sets 9 and 21, the active runs of all the chains 10 and 22 roll in erect position on the supporting guide rails 33, whilst their return runs roll in inverted position on suspending and guide-rails 34. For the upper sets 3 and 15, the return runs of all the chains roll in upright position on supporting guide-rails 35, whilst their active runs rest directly on the veneer 36 (FIG. 2) which is supported by the active runs of all the lower chains.

In FIG. 2, is shown, by way of indication, the frame of the machine as including uprights 37 on which are fixed, by welding or otherwise, upper cross-members 38 and lower cross-members 39, the various rails 33 to 35 being themselves fixed to the latter. The upper cross-members 38 support in addition an input pressure means 40 and an output pressure means 41, which are respectively associated with the input conveyor 1 and the output conveyor 2 and which, according to the invention, extend identically over the whole length of the effective zone of the machine, as shown in mixed lines in FIG. 1.

The pressure means 40 and 41 comprise respectively as many elastically deformable chambers 42 as there are pairs of upper 4 or 16, and lower, 10 or 22, endless chains, in the associated conveyor 1 or 2. Each chamber is constituted by a material which resists the processing temperatures of the veneers and all the chambers are supplied with fluid under regulatable pressure, for example, compressed air or water, as well be explained in detail below.

According to the invention, each of the chambers is arranged between an upper support plate, preferably constituted by a girder 43 fastened to the upper cross-members 38 of the machine, and a flexible layer which is preferably formed by a fixed chain 44 and which bears directly on rollers 31, 32 of the active run of the associated endless chain 4 or 16. It is obvious that the chain 44 is fixed only in the longitudinal direction of the machine, that is to say the direction of driving the veneer and of the active runs of the movable endless chains. In addition, this fixed chain has a width substantially equal to that of the upper movable chain 4 or 16 which is associated with it.

Due to the fact that each fixed chain bears directly on rollers 31, 32 of the active run of an upper input 4 or output 16 chain, it suffices to vary the pressure in the associated deformable chamber 42, which is supported on a girder 43, to vary the pressure exerted by the blocks 29 of said upper movable chain on the veneer 36.

This result is obtained due to the fact that the respective pressures of the fluid supplying the chambers are regulatable individually and simultaneously for each of the upper chains of a conveyor and for one and other of the two conveyors. Due to this fact, each fixed chain 44 is subjected to a regulatable and uniformly distributed pressure, which it transmits to the veneer through rollers and pallets or blocks of the active run of the associated movable chain.

Figure 3:
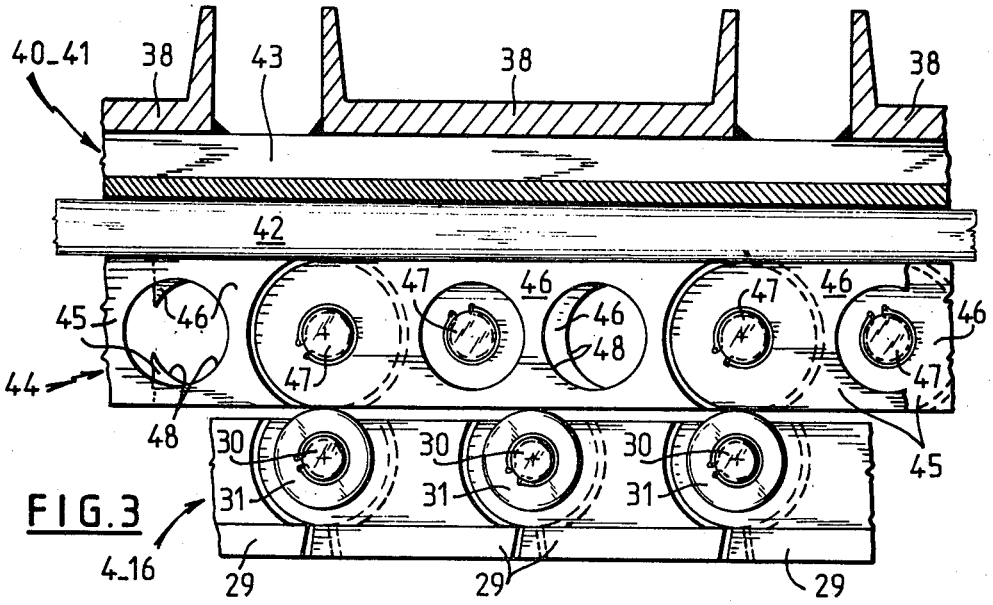
FIG. 3 is a partial side view of a pressure means bearing on an upper chain section.
Figure 4:
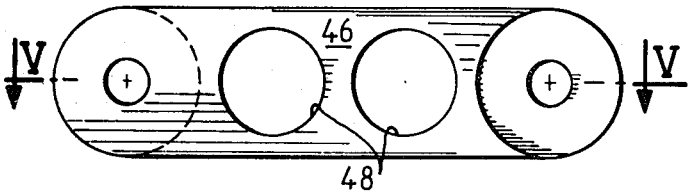
FIG. 4 is a side view of one of the plates forming a link forming part of the pressure means seen in FIGS. 2 and 3.
Figure 5:
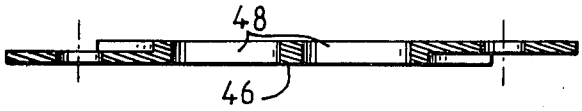
FIG. 5 is a sectional view on the line V—V of FIG. 4.

FIG. 3 shows a possible embodiment of a fixed chain 44 whose links 45 have preferably a length double that of the length of the links of the movable and heating chain 4 or 16. As is shown better in FIGS. 4 and 5, these links 45 may be constituted by several identical vertical plates 46 of which each end is thinned vertically and which are assembled contiguously on horizontal transverse hinge-pins 47, so as to form a block of which each of the two ends possess alternate longitudinal and vertical notches and teeth having respectively complementary forms with those of the alternate teeth and notches defined in the opposite end of the block of plates forming the neighboring link.

In addition, each link of a fixed chain may include open transverse and horizontal holes 48 having sufficient diameter for the free housing of one end of the hinge-pins 47 of the neighboring fixed chains.

Besides, there may be associated with the girders 43, lateral chamber-holding members 49(FIG. 2).

Figure 6:
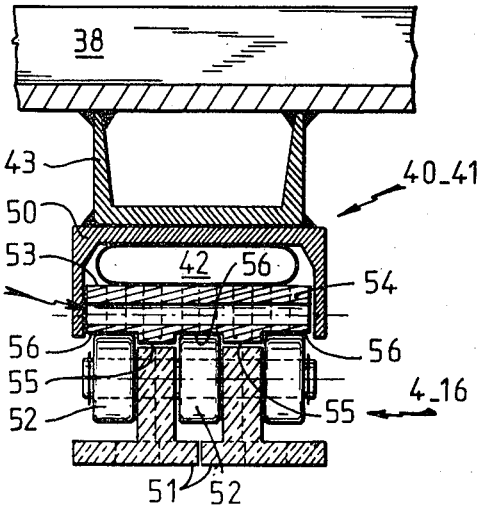
FIG. 6 is a cross-sectional view of another embodiment of a pressure means according to the invention.

If reference is now made to FIG. 6, the latter shows another embodiment of the pressure means, in which said lateral members are replaced by the wings of an angle bar 50 fixed to the girder 43 and surrounding both the chamber 42 and the fixed chain 44. In this same Figure, is shown a movable chain 4 or 16 including distinctly asymmetrical block links 51, hinged on axles 30 bearing three rollers 52 of substantially the same width.

FIGS. 7 and 8 show in detail a link 53 of the fixed chain 44 visible in FIG. 6. This chain is constituted by a solid block 54 of which each of the two ends includes alternate longitudinal and vertical notches and teeth having shapes respectively complementary with the alternate teeth and notches formed in the opposite end of the neighboring link. In addition, the lower surface 55 of each of the solid blocks forming the links 53 of each fixed chain include longitudinal grooves 56 intended for the relative guidance between said chain and the rollers of the active run of the associated movable chain. It is evident that these longitudinal grooves may also be formed in the lower surface of the link 45 before or after assembly of their constituent plates 46.

Fixed chains 44 of the previously described type are customarily called "block chains". According to the invention, these fixed chains have essentially the role of transmitting to the active runs of the upper movable chains and, consequently, to the veneers, the regulatable pressures occuring in the elastically deformable chambers.

In general, it is desirable that, from the input to the output of the effective drying and jointing zone of the machine, the pressing forces exerted on the active runs of the endless chains should vary decreasingly for the input conveyor 1 and increasingly for the output conveyor 2. To this end, each elastically deformable chamber 42 may be formed by a flexible tube or sleeve divided into several consecutive sections or lengths supplied separately and respectively subjected to different fluid pressures.

It is also possible to provide relatively elastic sleeves, whose lateral expansion would be limited by retaining members 49 or by the wings of the angle bar 50. However, it is preferable to form each elastically deformable chamber 42 in the shape of a flexible and substantially non-elastic sleeve, similar, for example, to a fire hose. In this case, an increase in the pressure of the fluid tends to communicate to the sleeve a circular cross-section and to reduce the width of the contact surface between the latter and fixed chain 44.

If reference is now made to FIG. 9, the latter shows, on a very much reduced scale, a pressure means of which the girder 57 is inclined. In fact, according to the invention, the girders, in principle horizontal, which are respectively associated with the chambers, may have a slight slope adjustable individually or simultaneously for each of the upper chains of one conveyor and for one and other of the two conveyors. Due to this fact, as is more visible in FIGS. 10 to 12, it is possible to vary the pressing force, since the surface of application varies, whilst the pressure remains uniformly distributed.

It thus is seen clearly that the association of an inclined girder and a flexible non-elastic sleeve enables a linear variation of the pressing force acting on the fixed chain to be obtained. The case of the girder with a negative slope seen in FIG. 9 corresponds obviously to an output pressure means 41 of which the pressing force increases linearly from the input to the output of the effective zone.

In other respects, there is shown in FIG. 9, a fixed chain 44 forming the flexible layer according to the invention, of which the two ends are anchored at 58 on the machine. The ends of/the elastically deformable chamber 42 may be obturated by transverse small plates or clips 59 whilst the regulation of the pressure can be carried out by means of pipes with which are associated respectively valves or supply and leakage cocks 60.

It should be noted that the pressure means according to the invention advantageously enable the use of the drying and jointing machine as a simple continuous press. In this case, the speeds $V_1$ and $V_2$ of the conveyors 1 and 2 are preferably equal and the girders 43 horizontal, so that the veneers are subject to a constant pressing force from input to output of the effective zone of the machine. In addition, due to the fact that the pressure means with a flexible sleeve and a flexible layer exert a uniformly distributed pressing force on the active runs and, consequently, on the veneers, it is possible to considerably reduce the power and the structural size of the machine with respect to conventional plate presses. It is also possible to construct a press only including a single conveyor with contiguous chains and, consequently, a single pressure means according to the invention.

In addition, it may be particularly advantageous to carry out the heating of the return runs by contact and no longer by passage into a heated chamber. To this end, referring to FIGS. 13A and 13B, the heating means which are respectively associated with the return runs of the upper 4, 16 and lower 10, 22 chains may be constituted by plates or metal trays 61 designed to transmit their heat by contact to the pallets or blocks of said chains. The trays 61 may obviously include electrical heating elements, but it is also possible to circulate therein a heating fluid such as steam, superheated water or a thermal fluid.

A thin slippage film 62, based on an antifriction resin and resistant to the temperature, is fixed on the surface of the plates 61 so as to reduce the friction and wear when the pallets or blocks associated with the links 29 of the chains slide against this surface. For example, this thin film may be based on polytetrafluorethylene.

The return runs of the lower chains 10, 22 (FIG. 13B) may obviously bear through their own weight on the associated thus coated plate 61, whilst the return runs of the upper chains 4, 16 (FIG. 13A) must be applied against the film 62 of the upper plate 61 by means of supplementary pressure means. Each of the latter may be similar to one of the input and output pressure means previously described and include at least one elastically deformable chamber 42 supplied with fluid under pressure and positioned between a fixed girder 43 and a flexible layer 44, which is fixed in the longitudinal direction of the machine and on which the rollers of the related return run roll.

According to the invention, it is possible to replace the chains with roller pallets previously described by known chains 63 with hinged pallets. Referring to FIGS. 14 and 15, each link 64 of such a chain 63 with hinged pallets is constituted by a metal plate, preferably of stainless steel, of which the two transverse ends have respectively longitudinal lugs rolled on themselves. The lugs of the two ends of a link are obviously complementary and the lugs of two adjacent links are connected through a hinge-pin 65 which is wedged into position.

Referring to FIG. 16, when such chains 63 with hinged pallets are used in the machine according to the invention, the support rails of the active runs of the lower chains, 10, 22 may be constituted by single girders 66 having a flat surface provided with a thin slip film 67 of the above-described type. Another thin slip film 68 is positioned between the active runs of the upper chains 4, 16 and the flexible and flat layers 44 forming part, with the chambers 42 and the girders 43, of the pressure means according to the invention. The veneer 36 is thus drawn between the active runs of the hinged pallet chains whose return runs may be heated by contact as previously indicated.

Independently of the upper 4, 16 and lower 10, 22 movable chains, the flexible layers 44 fixed in the longitudinal direction of the machine may be respectively constituted by two hinged pallet chains 63, which are in principle offset longitudinally with respect to one another and mounted face to face or with facing hinges.

Referring to FIG. 17, according to another feature of the invention, the set of lower chains 10, 22 of the machine may be constituted by a thin endless conveyor belt 69 based on an antifriction resin and resistant to temperature. This belt is drawn, at its two ends by cylinders 70, 71 whose periphery is coated, for example, with rubber. In this embodiment, a heating device with heat transmission by contact of the above-described type may be associated directly with the active run of the belt.

It is to be noted that the thin conveyor belt 69 forming the lower set may have a considerable length and correspond to several consecutive sets of upper chains 4, 16 forming successive input and output conveyors, in which case the active run of said belt can slide on a succession of heating and cooling means with contact transmission of heat.

Figure 18:
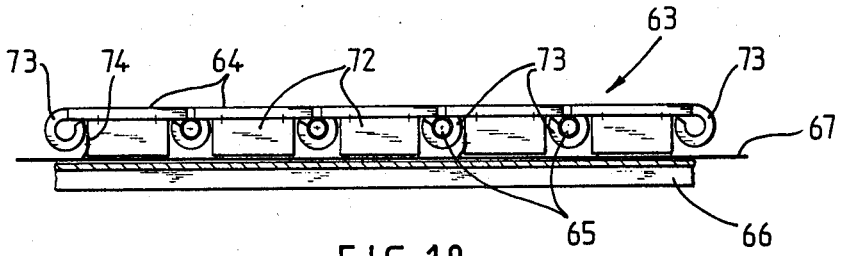
FIG. 18 is a partial side view of a hinged pallet chain section including bars and, possibly, brushes.

According to another feature of the invention, it may be advantageous to modify the known hinge pallet chains, such as the movable chains 63 described with reference to FIGS. 14 to 16, so as to increase their weight and, consequently their calorific mass, whilst avoiding premature wear of the hinges on sliding of said movable chains against the thin antifriction films such as films 67, 68. To this end, referring to FIG. 18, a solid bar or plate 72 may be fixed directly beneath each of the links 64 of the endless chain 63, this bar having a thickness greater than that of the hinges 73 formed by rolling longitudinal lugs of the links 64 around hinge-pins 65. As a result the hinges 73 are no longer in contact with the thin films, for example the antifriction film 67 in the case represented in FIG. 18, and only the bars 72 bear against the latter.

The bars 72 may be constituted by a metal or by a plastics material, notably a material based on polytetrafluorethylene, the choice of constituent material of the bars being a function of the calorific mass and of the weight desired for each link 64 of the movable chains 63. These bars 72 may be fixed beneath the links 64, between the hinges 63, by any suitable means, notably by screwing, by welding or even by gluing, for example by means of a high temperature resistant glue.

Also, to remove dust and other elements capable of deteriorating the thin films, such as the films 62, 67 and 68, certain bars 72 may be provided with brushes 74, for example laminations of a material based on polytetrafluorethylene fixed along a transverse surface of the bars so as to sweep the surface of the film on their sliding against the latter.

In general, in the case where the girder 66 is replaced by a plate or a heating plate or a tray such as those denoted by 61 and described with reference to FIGS. 13A and 13B, the movable chains 63 may then be heated by contact and through bars 72 at the level of their active runs, that is to say in the drying and/or jointing zone, and no longer only at the level of their return runs.

Figure 19:
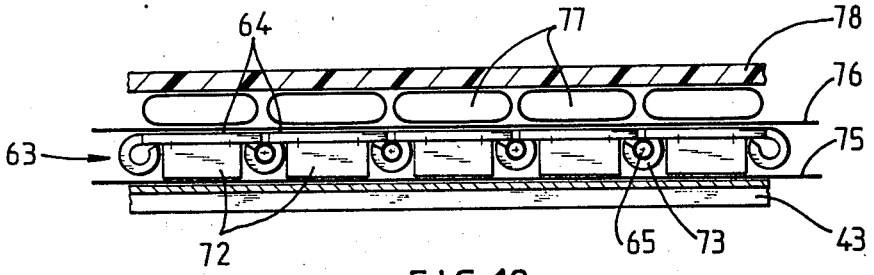
FIG. 19 is a partial side view of a flexible tube heating device associated with hinged pallet chains provided with bars.

However, the existence of the bars 72 also enables the suppression of the fixed chains 44 and of the pressure means with elastically deformable chambers 42, to be envisaged, as shown in FIG. 13A and designed to apply the return run of the movable endless chains 4 and 16 against the heating plate 61. For example, with reference to FIG. 19, the return run of the hinged pallet chain 63 bears on the girder 43 through a thin antifriction film 75, on which slide the bars 72 associated with the links 64, the latter sliding under a second thin antifriction film 76 on which the flattened tubes or flexible hoses 77 rest and traversed by a heating fluid and supporting an insulating panel 78.

Figure 20:
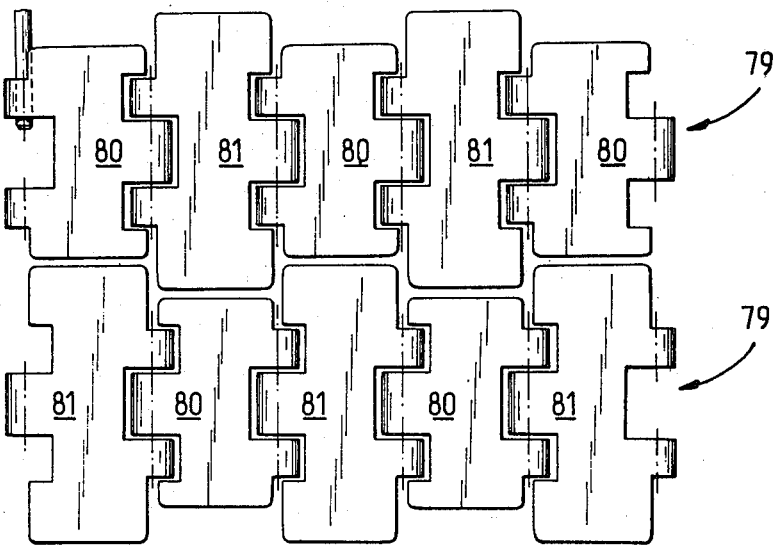
FIG. 20 is a partial view from above of two neighboring chains with hinged pallets whose links have alternately different and complementary widths.

According to another feature of the invention, referring to FIG. 20, certain endless chains, notably the lower chains 10 and 22 of input and output conveyors 1 and 2 may be constructed in the form of hinged pallet chains 79 whose links 80 and 81 have alternately different and complementary widths, so that the links of two neighboring chains can be intercalated or juxtaposed contiguously along a broken line, thus enabling any linear marking of the veneer in the course of its drying to be avoided.

In the case where the lower chains 10 and 22 are constructed as indicated above, the upper chains 4 and 16 are preferably constructed as previously indicated with reference to FIGS. 14 and 15 so as to include chains, for example even and odd, driven independently and associated respectively with input and output conveyors 1 and 2. Under these conditions, the upper chains 16 of the output conveyor 2 may be drawn, simultaneously with all the lower chains 10 and 22, at the output speed $V_2$, whilst the upper chains 4 of the input conveyor 1 may be drawn at the input speed $V_1$ higher than the output speed $V_2$.

It is then preferable to apply to the surface of the links 64 of the upper chains 4 of the input conveyor 1 a thin non-skid coating designed to facilitate the driving of the veneer, for example a product of the elastomer type resistant to high temperature and compatible with the constituent material of the thin antifriction films.

In addition, to enable thick veneers, even boards, to be treated, it may be particularly useful to increase the speed of the chains considerably with respect to that of the veneer, notably close to the input zone of the machine.

Other modifications may be introduced into the embodiments described, within the field of technical equivalents, without departing from the scope of the invention.

What is claimed is:

1. In a machine for drying and butt-jointing unwound or sectioned wood veneer by continuous contact engagement, comprising an effective drying and jointing zone defined therein, said machine including an input conveyor and an output conveyor which are driven independently, each of said conveyors including an upper set and a lower set forming pairs of endless chains with pallets, said chains each having an active run and a return run, sprockets for simultaneously driving said chains and roller means for guiding their active and return runs by running on respective supporting guide-rails, said active runs facing each other compressing the veneer therebetween and conveying it in the longitudinal direction of the machine, means for heating said runs of said chains, a first pressure means positioned directly over the pairs of chains of the input conveyor in the effective zone, a second pressure means positioned directly over the pairs of chains of the output conveyor in the effective zone, the improvement consisting in that said first and second pressure means are positioned and extend identically over every point of the length of the whole effective drying and jointing zone of the machine, said first and second pressure means comprise respectively as many elastically deformable longitudinal chambers as there are pairs of upper and lower endless chains in the associated conveyor, said chambers are supplied with upper support plate constituted by a longitudinal girder, which is fastened to the machine, and a flexible and relatively heavy layer, formed by a chain of interarticulated links, fixed in the longitudinal direction of the machine, having a width corresponding to that of the associated upper chain, bearing directly on said rollers of the active run of said chain and subjected to pressure from said deformable chamber pressing against said plate.

2. Machine according to claim 1, wherein the flexible layer associated with each chamber is formed by a fixed chain whose two ends are anchored on the machine and of which the links are articulated two by two on horizontal transverse axles, each link of one fixed chain including transverse and horizontal open holes having a sufficient diameter for the free housing of one end of the hinge-pins of the neighboring fixed chains.

3. Machine according to claim 1, wherein each link is constituted by several identical vertical plates of which each end is thinned vertically and which are assembled contiguously on the hinge-pins so as to form a block of which each of the two ends possesses notches and alternate longitudinal and vertical teeth having shapes respectively complementary with those of the teeth and alternate notches defined in the opposite end of the block of plates forming the neighboring link, the lower surface of each of the blocks forming the links of each fixed chain including longitudinal grooves designed for the relative guidance between said chain and the rollers of the active run of the associated movable chain.

4. Machine according to claim 1, wherein the chambers are constituted by a material which withstands the temperatures for treating the veneers and the respective pressures of the fluid supplying the chambers are individually and simultaneously regulatable for each of the upper chains of the input and of the output conveyor.

5. Machine according to claim 1, wherein each chamber is formed by a flexible sleeve divided into several consecutive sections respectively supplied with different fluid pressures.

6. Machine according to claim 1, wherein the chambers are each formed by a flexible and non-elastic sleeve and wherein the substantially horizontal girders which are respectively associated with the chambers may have a slight slope adjustable separately for each of the upper chains of the input conveyor and of the output conveyor.

7. Machine according to claim 1, wherein the means for heating the runs of the upper and lower chains are constituted by plates for heat transmission by contact within which circulates a heating fluid selected from the group consisting of steam, superheated water and thermal fluid and on the surface of which are respectively fixed thin slippage films based on an antifriction resin and resistant to temperature, additional pressure means being associated with at least the return runs of the upper chains.

8. Machine according to claim 1, wherein the upper and lower chains are of the hinged pallet type, the supporting guide-rails of the active runs of the lower chains having a flat surface provided with a thin slippage film, another thin slippage film being arranged between the active runs of the upper chains and the flexible layers of the associated pressure means.

9. Machine according to claim 1, wherein the flexible layers are respectively constituted by two hinged pallet chains, offset longitudinally with respect to one another and mounted with facing hinges.

10. Machine according to claim 1, wherein the set of lower chains of the machine is constituted by a thin endless conveyor belt based on antifriction resin and withstanding the temperature and driven by cylinders arranged at its two ends, heating means with heat transmission by contact being associated directly with the active run of the belt.

11. Machine according to claim 1, wherein the chains are of the hinged pallet type and include solid bars fixed respectively beneath the links and having a thickness greater than that of the hinges, brushes being if necessary fixed along a transverse surface of the bars, and additional means for heating by contact being if necessary associated with the active runs of said chains.

12. Machine according to claim 1, wherein the return run of the chains of the hinged pallet type provided with bars is positioned between a support girder and a heating means with flattened flexible hoses, a thin slippage film being positioned between said return run and said girder and a second thin slippage film being positioned between said return run and said heating means.

13. Machine according to claim 1, wherein certain chains of the hinged pallet type include links having alternately different and complementary widths.

* * * * *